US006295485B1

(12) United States Patent
Gleeson et al.

(10) Patent No.: US 6,295,485 B1
(45) Date of Patent: Sep. 25, 2001

(54) CONTROL OF LUBRICANT PRODUCTION BY A METHOD TO PREDICT A BASE STOCK'S ULTIMATE LUBRICANT PERFORMANCE

(75) Inventors: James William Gleeson, Sewell; William Francis Heaney, Mount Laurel; Eugenio Sanchez, Sewell, all of NJ (US); Viswanathan Visweswaran, Dallas, TX (US)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/240,976

(22) Filed: Jan. 29, 1999

(51) Int. Cl.[7] ..... G05B 21/00; C10G 69/02

(52) U.S. Cl. ..... 700/272; 700/271; 700/270; 208/60

(58) Field of Search ..... 700/29, 30, 40, 700/266, 270, 271, 272; 208/131, 50, 146, 60, 27; 585/533, 520

(56) References Cited

U.S. PATENT DOCUMENTS

| | | | | |
|---|---|---|---|---|
| 3,666,931 | | 5/1972 | Woodle | 235/151.12 |
| 3,686,488 | | 8/1972 | Woodle | 235/151.12 |
| 3,828,171 | | 8/1974 | Griffin | 235/151.12 |
| 4,053,744 | | 10/1977 | Woodle | 700/272 |
| 4,794,534 | * | 12/1988 | Millheim | 702/9 |
| 4,866,632 | | 9/1989 | Mead et al. | 700/272 |
| 4,913,794 | * | 4/1990 | Le et al. | 208/18 |
| 5,046,846 | * | 9/1991 | Ray et al. | 702/22 |
| 5,260,865 | | 11/1993 | Beauford et al. | 700/270 |
| 5,349,541 | | 9/1994 | Alexandro, Jr. et al. | 209/155 |
| 5,412,581 | * | 5/1995 | Tackett | 702/30 |
| 5,446,681 | * | 8/1995 | Gethner et al. | 702/27 |
| 5,598,329 | | 1/1997 | Niemann | 208/59 |
| 5,617,321 | | 4/1997 | Frizelle et al. | 208/19 |
| 5,691,895 | | 11/1997 | Kurtzberg et al. | 585/1 |
| 5,699,270 | | 12/1997 | Ashe et al. | 208/108 |
| 5,725,755 | | 3/1998 | Forbus | 208/27 |
| 5,727,128 | | 3/1998 | Morrison | 208/33 |
| 5,740,033 | | 4/1998 | Wassick et al. | 585/533 |
| 5,752,007 | | 5/1998 | Morrison | 208/27 |

FOREIGN PATENT DOCUMENTS

| | | |
|---|---|---|
| 09-6865 | 10/1989 | (JP) . |
| WO 91/01481 | 2/1991 | (WO) . |
| WO 93/25944 | 12/1993 | (WO) . |

OTHER PUBLICATIONS

Baxley, Jr., R.A. "Computer Control of Severity in Ethylene Cracking Furnaces", *Instrumentation Tech.,* 1971, 39–42.

Stipanovic, A.J. et al., "Having Fun with Base Oils: Predicting Properties Using Neural Networks", Symposium on Worldwide Perspectives on the Manufacture, Characterization and Application of Lubricant Base Oils, 21th National Meeting, American Chemical Society, San Francisco, CA, Apr. 13–17, 1997, 284–286.

* cited by examiner

*Primary Examiner*—William Grant
*Assistant Examiner*—Kidest Bahta
(74) *Attorney, Agent, or Firm*—Malcolm D. Keen

(57) ABSTRACT

A model to predict the quality of a lubricant base stock for use in a plurality of products having a plurality of viscosities. The compositional model is based on a quantitative analysis of key compositional parameters and performance criteria for the plurality of products representing the plurality of viscosities. The compositional model predicts whether the composition of a new lubricant base stock is similar or dissimilar to known lubricant base stock compositions that have previously passed or failed performance tests. New base stock compositions, then, are evaluated in light of base stocks that have demonstrated acceptable performance in a plurality of products. The compositional model also predicts whether a combination of refinery streams can be blended for use in manufacturing a lubricant base stock.

50 Claims, 5 Drawing Sheets

CONTROL OF LUBRICANT PRODUCTION BY A METHOD TO PREDICT A BASE STOCK'S ULTIMATE LUBRICANT PERFORMANCE

RELATED APPLICATIONS

The present invention is related by subject matter to the inventions disclosed in commonly assigned application having Ser. No. 09/240,027, now abandoned filed on Jan. 29, 1999, entitled "Control of Crude Refining by a Method to Predict a Lubricant Base Stock's Ultimate Lubricant Performance,".

FIELD OF THE INVENTION

The present invention is directed to petroleum-based lubricants. More specifically, the present invention relates to a method for controlling lubricant production by predicting the quality of the final lubricant product in view of product performance tests and specific compositional parameters.

BACKGROUND OF THE INVENTION

Lubricating oils are, for the most part, based on petroleum fractions that boil above about 232 degree C (450 degrees F). The molecular weight of the hydrocarbon constituents is high and these constituents display almost all conceivable structures and structure types depending in large part on the type of crude oil from which they were prepared.

The rationale in lubricant refining is that a suitable crude oil, as shown by experience or by assay, can be refined into lubricant base stock having a predetermined set of properties such as, for example, appropriate viscosity, oxidation stability, and maintenance of fluidity at low temperatures. The refining process employed to isolate the lubricant base stock currently consists of a set of subtractive unit operations which remove the unwanted components. These unit operations include distillation, solvent refining, hydroprocessing, and dewaxing, each of which is basically a separation process.

A lubricant base stock (i.e. from a refined crude oil) may be used as a lubricant component, or it may be blended with another lubricant base stock having somewhat different properties. A particular base stock, prior to use as a lubricant, is conventionally compounded with one or more additives such as antioxidants, extreme pressure additives, and viscosity index (V.I.) improvers. As used herein, the term "stock," regardless of whether the term is further qualified, refers only to a hydrocarbon oil without additives. The term "solvent-refined stock" or "raffinate" refers to an oil that has been solvent extracted, for example with furfural. The term "dewaxed stock" refers to an oil which has been treated by any method to remove or otherwise convert the wax contained therein and thereby reduce its pour point. The term "waxy" as used herein refers to an oil of sufficient wax content to result in a pour point greater than 4 degrees C. (+25 degrees F.). The term "base stock" refers to an oil refined to a point suitable for some particular end use, such as for preparing an automotive oil, marine oil, hydraulic oil, etc.

The current practice for the preparation of high grade lubricating oil base stocks is illustrated in FIG. 1. The overall process is designated as 10. The first step is to vacuum distill an atmospheric tower residuum from an appropriate crude oil (step 100). This step provides one or more raw stocks within the boiling range of about 700 degrees F to about 1000 degrees F designated as light 15 (from about 700 to about 810 degrees F), medium 20 (from about 810 to about 890 degrees F), and heavy 30 neutrals (from about 890 to about 1000 degrees F), and a vacuum residuum 40. Each stock is characterized by a different viscosity range, e.g., light neutral stocks have the lowest viscosity range (from about 3.5 to about 5.5 Kv at 100 degrees C) and heavy neutral stocks have the highest viscosity range (from about 10.0 to about 15.3 Kv at 100 degrees C). After preparation, each raw stock is extracted with a solvent, e.g., furfural, phenol or chlorex, which is selective for aromatic hydrocarbons, and which removes undesirable components (step 140). The vacuum residuum 140 usually requires an additional step to remove asphaltic material prior to solvent extraction (step 120). The raffinate from the solvent refining is generally very waxy and typically requires a dewaxing operation (step 160). Dewaxing raffinates is generally carried out by solvent dewaxing or catalytic dewaxing under conditions which produce a predetermined or target pour point for the base stock.

The art of lube base stock production may further require an additional step of hydroprocessing the dewaxed stock (step 180). Hydroprocessing is the addition of hydrogen to the stock for the purpose of removing certain impurities that may be detrimental to lubricant performance, depending upon the final lubricant product specifications. Hydroprocessing is especially useful for removing sulfur as the hydrogen combines with sulfur to form hydrogen sulfide. Either the dewaxing step (step 160) or the hydroprocessing step (step 180), or both, can yield a stock of sufficient quality to be used as a base stock for final lubricant formulation.

Suitable materials, or additives, are then added to the base stock to augment the base stock's lubricating properties and to meet the required specifications, such as viscosity index (VI) (shown in FIG. 6).

Historically, lubricant manufacturing has been inflexible. Base stock produced from new crude sources is considered to be a "new" base stock and must be approved for use as a lubricant. The lube base stock approval system requires that a base stock produced from a new crude undergoes a costly and time-consuming approval process before it can be used as a lubricant oil. Full approval for samples produced from a new crude or base stock requires extensive bench and engine testing which generally takes 5 to 10 months to complete. Changes in process conditions also require re-approval with additional bench and engine testing. The high cost of bench and engine testing discourages optimization of process conditions on all but the most frequently run crudes. In addition, the need to streamline this system has become increasingly important as a result of the rapid changes in crude mixes from at least some geographic locations, quality concerns over purchased base stocks, and the drive for economic benefits from increased lube flexibility. Therefore, there is a need in the art for increased flexibility in lubricant production and to streamline the approval system for lube crudes, base stocks, and blends thereof.

SUMMARY OF THE INVENTION

In one embodiment of the present invention, a method for selecting a lubricant base stock for use in manufacturing a lubricant for a particular application is provided. Each lubricant base stock is characterized according to a plurality of compositional components common to all lubricant base stocks and each compositional component varies in amount with respect to each base stock. A model predicting the performance of a lubricant base stock in a final lubricant product is formed by identifying particular ones of the plurality of compositional components in a lubricant base stock that are probative of lubricant performance for a plurality of applications, in combination.

An acceptable range is next determined for a combination of identified compositional components from a plurality of performance tests required of a plurality of lubricant products where each lubricant product has a viscosity and the plurality of lubricant products each have a different viscosity. After the acceptable region is determined, adjustments are made for viscosity variations of each lubricant base stock by predicting the amounts of the compositional components from at least one other acceptable range for a base stock of a different viscosity wherein the acceptable range is determined for a combination of the identified compositional components from the plurality of performance tests, each lubricant product having a viscosity, the plurality of lubricant base stocks having a plurality of different viscosities.

A candidate base stock is then analyzed to determine the amounts of the identified components. It is then determined whether the amount of each identified component, in combination, in the candidate base stock is within the acceptable performance range.

In another embodiment of the present invention a method is provided for blending lubricant base stocks whose composition falls outside of the acceptable region predicted by the compositional model. This method begins with determining the acceptable region and adjusting for viscosity variations as described above. Next, two or more lubricant base stocks with complementary compositions are selected. The amount of each required to be combined to define the final lubricant composition within the acceptable region as predicted by the compositional model is calculated. The lubricant base stocks are then blended.

In yet another embodiment of the present invention, a method is provided for blending a combination of petroleum refinery streams to be used as a lubricant base stock, wherein each of the streams are capable of being refined into lubricant base stocks. This method begins with determining the acceptable region and adjusting for viscosity variations as described above. Next, the amounts of the identified compositional components are identified for a lubricant base stock which is to be refined from the plurality of refinery streams and the composition of the blend is determined in accordance with the combination of identified components within the acceptable range as determined by the model. The streams are then blended in accordance with the determined composition.

In one variation of this embodiment, the refinery streams are crudes. In another variation of this embodiment, the refinery streams are selected from any one of the unit processes in the refinery.

DETAILED DESCRIPTION OF THE INVENTION

In the present invention, a computer model (801 in FIG. 7) is created and used to predict the quality of a lubricant base stock for use in a plurality of products having a plurality of viscosities. The model is based upon a quantitative analysis of key compositional parameters and performance criteria for a plurality of products representing a plurality of viscosities. Such model is herein referred to as comprehensive compositional model and, as will be shown, is comprised of compositional models developed for specific viscosities.

The compositional models predict, among other things, whether the composition of a new lubricant base stock is similar or dissimilar to known lubricant base stock compositions that have previously passed or failed performance tests. New lubricant base stock compositions are, thus, evaluated in light of lubricant base stocks that have demonstrated acceptable performance in a plurality of products.

Figure 2:
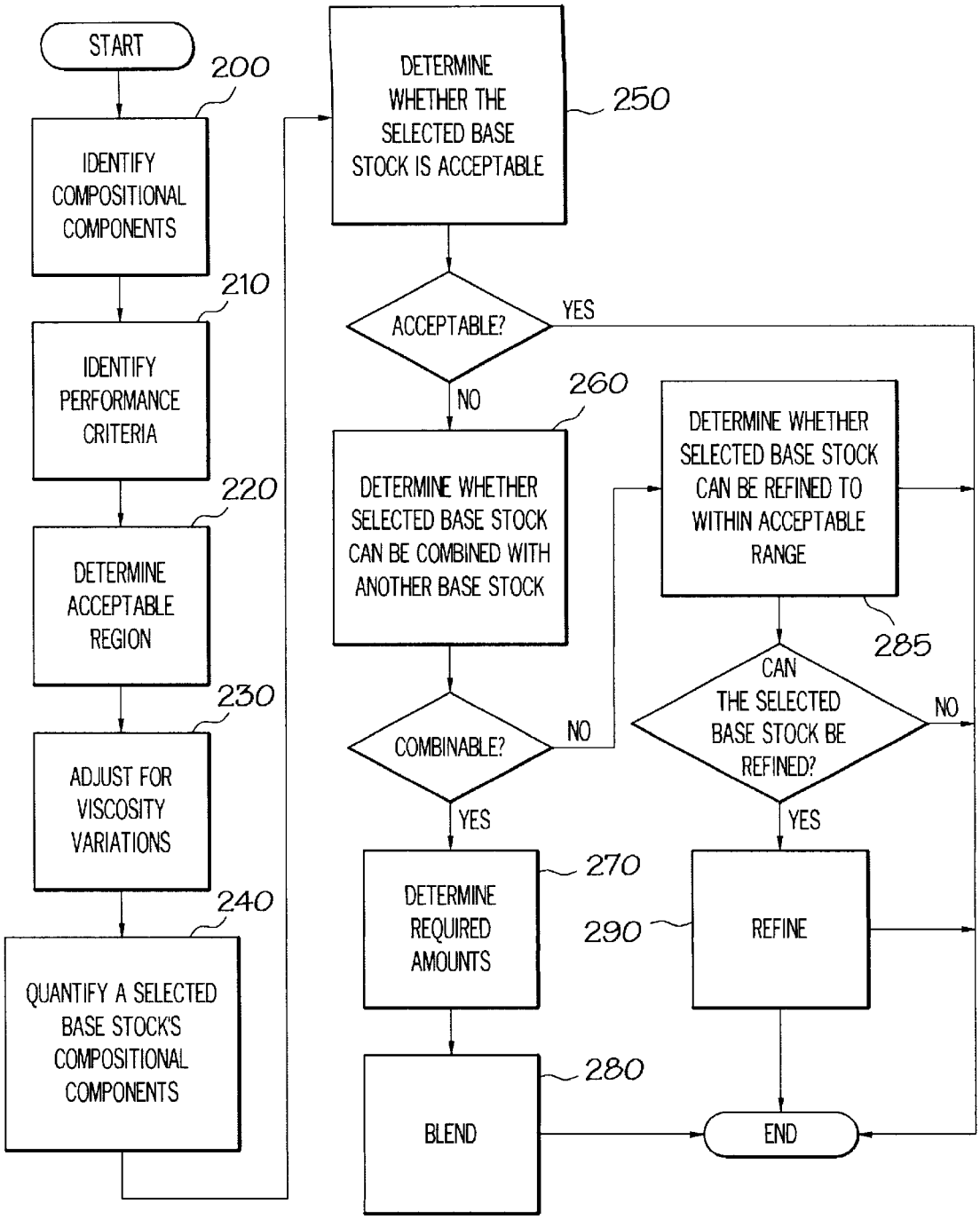
FIG. 2 is a flow diagram showing the method of the present invention.

Statistical analysis of base stock properties has shown that lubricant performance may be predicted from the chemical composition of the base stock. In particular, the various chemical compositional parameters are combined to obtain a comprehensive prediction of lubricant performance. FIG. 2 is a process flow diagram illustrating a method, to predict a base stock's lubricant performance in accordance with one embodiment of the present invention. The compositional parameters incorporated into the compositional model are chemical components of the base stock that have been identified as significantly contributing to lubrication performance (step 200). Examples of such components are, for example, total sulfur, aliphatic sulfur, basic nitrogen, aromatic distribution, nitrogen, aliphatic compound distribution, degree of aliphatic chain branching, molecular weight distribution or any combination thereof. The preferred embodiment includes total sulfur, aliphatic sulfur, basic nitrogen, total aromatics, aromatic ring distribution, or a combination thereof.

At a minimum, only two of the factors are used to create the compositional model to accurately predict a base stock's lubricant performance in a final lubricant formulation. All of the components are quantitatively determined according to standard analytical chemistry techniques. Total aromatics, for example, are determined from a chemometric correlation of the UV spectrum. Specifically, a Perkin-Elmer Lambda 19 spectrometer is used. The aromatic ring distribution is determined by conventional techniques known to those skilled in the art for classifying aromatic rings. Basic nitrogen is determined according to ASTM Method D2896. Total sulfur is determined by ASTM method D2622. The aliphatic sulfur content may be determined by UV spectrophotometry based on the quantitation of an iodine complex of the aliphatic sulfides according to the technique described by Drushel and Miller in Anal. Chem. 27, 495 (1955); and Anal Chem. 39, 1819 (1967), both of which are herein incorporated by reference. This method, which suitably measures absorbance of the complex at 310 nm, provides a reliable determination of aliphatic sulfur, being free of interferences by nitrogen compounds and the aromatic hydrocarbons indigenous to lubestocks.

Determining the compositional model's performance parameter (step 210) comprises evaluating the performance of a plurality of products having different viscosities. It has been found that variation of the compositional model's parameters as described below in accordance with variations in the viscosity of the lubricant products provides superior prediction of lubricant performance as compared to scaling compositional parameters in accordance with viscosity. The viscosities of the products are, thus, a function of the products' end use.

For example, the compositional model's performance parameters include engine oil performance of automotive engine lubricants, marine engine performance of marine engine lubricants, industrial equipment performance of industrial equipment lubricants, and hydraulic performance of hydraulic lubricants. As each application requires a product of a different viscosity, the compositional model thereby incorporates a plurality of kinetic viscosities ranging from about 3.5 to at least about 20 centistokes at 100 degrees C.

As will be shown, adjustments for viscosity variations may be made by simple linear interpolation derived from similar compositional models, having different determined parameters from different viscosities. It is also possible although less preferred to adjust for viscosity changes by scaling composition rather than model parameters for viscosity variations between samples processed to similar viscosity index from the same crude. It has been found that the composition factors scale with viscosity according to a power law where the composition at a selected temperature and viscosity is related to the composition at a reference viscosity scaled by a power of the ratio between the viscosities at the selected temperature and the reference temperature; in this relationship, the exponent value varies typically from −2 to 2 (depending on measurement unit and possibly other empirically determined factors) for the compositional factors referred to above, with the value in many cases being in the range 0.1 to 1.0. The greatest sensitivity in the scaling relationship has been found to exist with respect to the basic nitrogen content and the least with total aromatics, polycyclic aromatics (two or more rings) and sulfur (total and aliphatic) occupying comparable intermediate rankings.

Minor variations in viscosity outside the range determined by the compositional model may also be extrapolated. It has been found satisfactory to generate compositional models for each lubricant type such as, for example, light and heavy neutrals, using a limited range of viscosity values rather than to use a single value of viscosity for each type. As will be shown, the comprehensive compositional model will incorporate the separate compositional models.

The limits of the performance parameters are determined by industry standard performance tests specific to the particular products and corresponding viscosities. For example, for products made from light neutrals, the following performance tests (accompanied by the particular application and acceptable performance level) may be used as examples of performance tests by which lubricant performance may be assessed. Other performance tests may be used according to standard requirements of the lubricant manufacturer.

| Test | Performance Level |
|---|---|
| Sequence IIIE (Automotive oils) | ACEA A3-96 |
| Sequence VE (Automotive Oils) | ACEA A3-96 |
| Mack T-8 (Automotive oils) | Mack EOL |
| TOST life (Hydraulic oils) | >1500 hr |

For products made from heavy neutrals, the following performance tests (accompanied by the particular application and acceptable performance level) may be used as examples of performance tests by which lubricant performance may be assessed. Other performance tests may be used according to standard requirements of the lubricant manufacturer:

| Test | Performance Level |
|---|---|
| Cat 1-G2/1M-PC (Marine oils) | CF |
| Cat 1M-PC (Automotive oils) | CF |
| TOST life (Hydraulic oils) | >1000 hr |

Such tests are known to those skilled in the art of performance testing. For the purpose of making the compositional model, a lubricant product, when tested according to any one of the above tests, is designated as either "pass" or "fail."

Next, an acceptable region in a multi-dimensional space, indicating good lubricant performance, is determined by defining the performance boundaries (i.e., "pass" or "fail") with respect to key compositional parameters. This is accomplished over a broad range of product applications and viscosities. Such acceptable region is then represented by the compositional model. The end result is that the compositional model allows lubricant performance to be predicted over all possible base stock compositions and viscosities.

To develop a comprehensive compositional model (step 220), separate compositional models are first developed for specific viscosities. The model parameters for a test viscosity are found by interpolating between the parameters of the model at the nearest higher viscosity and the parameters of the model at the nearest viscosity lower than the test viscosity. The following describes how to develop the comprehensive compositional model by first developing separate compositional models for a light neutral viscosity (kinematic viscosity at 100 degrees C of about 4.5 cSt) and a heavy neutral viscosity (kinematic viscosity at 100 degrees C of about 12.5 St). Small variations in the viscosity of the samples tested from these viscosities, such as within the viscosity grade, were accounted for by scaling the composition according to typical trends of composition with viscosity. These can be readily determined by those skilled in the art by fitting the trends in composition with viscosities that are produced from the same crude:

Composition Scaled=(composition at $y$ $kv100C$)×(y/reference viscosity)^z, wherein ^ is "taken to the power of;" the reference kinematic viscosity at 100C is 4.5 or 12.5 cSt; and z is typically between 0 and 1.

In view of the above, developing the acceptable region (step 220) for the individual compositional models are the same for base stocks of all viscosities. A series of base stocks are performance tested for a plurality of product formulations that employ base stocks of the same viscosity range. Preferably, each of the lubricant product formulations are lubricant products for different applications, i.e., automotive, hydraulic, industrial, etc. As herein described, regions are drawn around the points that are a "pass" for each formulation, where such regions exclude the "failed" base stocks.

A method employed to determine the acceptable regions, i.e., the regions drawn around the points that are a "pass" for each formulation, is preferably a technique involving cluster analysis of the performance test data. One such technique is, for example, Soft Independent Classification Analysis (SIMCA) as described by Muhammad A. Sharaf, Deborah L. Illman, and Bruce R. Kowalski's *Chemometrics,* John Wiley & Sons, Inc., New York 1986, which is hereby incorporated by reference. SIMCA models were constructed to model base stock compositions that have either passed or failed engine tests. The SIMCA models first depend, however, on various feature or variable selection techniques used to screen the base stock properties. The screening techniques determine the optimal inputs for a classification model. Two univariate strategies, variance and Fischer weights, are employed to select the variables that discriminate between passing and failing engine tests.

The variance weight is the ratio of inter category variance and the sum of the intra-category variances for a given property. It approximates the distance between two distributions. For example the total variance for the percent aromatic fraction of the base stock is calculated for passing Caterpillar 1-G engine tests and is divided by the sum of the variance for the passing tests. Overall variance weights for n>2 categories are the geometric mean of the individual category variance weights. The variance weights are given by the formula:

$$w_k(P, F) = 2 \times \frac{(1/N_p)\sum x_p^2 + (1/N_F)\sum x_F^2 - (2/N_P N_F)\sum x_P \sum x_F}{(1/N_p)\sum (x_p - \bar{x}_p)^2 + (1/N_F)\sum (x_F - \bar{x}_F)^2}$$

where:

w=Variance weight for two categories;

x=Base stock compositional parameter, i.e. sulfur, aliphatic sulfur, basic nitrogen, or aromatic distribution;

N=Number of samples in a given class; and

P or F=Denotes the Pass or Fail data

The following is an example of variance weights for two base stock clusters:

| | Total Aromatics | 2+ Aromatics | Basic Nitrogen | Sulfur | Aliphatic Sulfur | Thiophenes | 2+-Thio |
|---|---|---|---|---|---|---|---|
| weight (p/f) | 7.72 | 10.90 | 2.08 | 11.44 | 4.99 | 15.05 | 3.71 |

Larger numbers indicate a greater likelihood that the category discriminates between the passing and failing tests. In the current example, the largest number for thiophenes indicates that it is the most significant. In this way, one can choose to use the most significant categories first in the analysis.

A Fischer weight uses the distance between mean values in the two distributions divided by the sum of variances to determine the discriminating power of the variables. Overall, the Fischer weights for n>2 categories are the mean of the individual category fisher weights. The fisher weight is given by:

$$w_k(P, F) = \frac{|\bar{x}_p - \bar{x}_P|}{(1/N_p)\sum (X_p - \bar{x}_P)^2 + (1/N_F)\sum (x_F - \bar{x}_F)^2} \quad \text{(A-2)}$$

The SIMCA method uses principal component analysis to construct a model for each class, i.e. pass/fail. Factor analysis is used to calculate the significant chemical patterns for each class. The significant patterns are known as the principal components. The principal component analysis provides a convenient method for data compression. It also provides a rotation of the data (base stock composition) to an orthonormal basis, removing any co-linearities in the data. The principal components form a new set of axes for the data (base stock properties).

Two key statistical tests, the F-test and the Mahalanobis Distance, are used to evaluate the compositional models. The F-test is a measure of the residual error which describes the distance between a sample and the space defined by the principal components. The Mahalanobis Distance describes the distance from the compositional centroid of the compositional model. The F-test determines if the error associated with a sample is statistical error or whether it is due to the inability of the principal components to model the data. The Mahalanobis distance indicates whether the prediction is an extrapolation of the compositional model.

The compositional models are used by projecting unknown samples into each model. The chemical patterns for each model are applied to the new base stock. The residual error and the distance from the centroid of each class form a basis for determining the similarity of unknown samples. The unknown samples may belong to one or several classes.

Soft models, i.e., the local clusters of data independently modeled and independent models, are used to accurately predict or classify samples. For example, base stock compositions that have demonstrated passing performance in the Caterpillar 1-G2, for example, can be considered as one cluster; failing base stock compositions are therefore another cluster. The passing samples will form the basis for one model and the failing samples form the basis for a second model. SIMCA combines cluster analysis with principal components regression. This technique involves supervised learning; the samples used to build the compositional models must be classified.

SIMCA uses principal component analysis (PCA) to calculate the chemical patterns for each class. The PCA provides a statistical basis for selecting the significant chemical patterns. The PCA provides a technique for re-expressing the original data. The original data matrix, the base stock properties, $X_i$, is decomposed to a linear combination of scores, $L_i$ (weights) and eigenvector patterns $V_i^T$:

$$X_i = L_i V_i^T \quad \text{(A-3)}$$

Several techniques are available for decomposing a matrix. One technique for decomposing a matrix is the Singular Value Decomposition, SVD as described by Golub, Gene H., and Charles Van Loan, in *Matrix Computations,* 2nd Edition, p.70, The Johns Hopkins University Press, Baltimore (1989), hereby incorporated by reference:

$$X_i=U_iS_iV_i^T \tag{A-4}$$

The SVD provides two orthogonal matrices U and V that can be used to build the SIMCA models. The diagonal of the S matrix contains the singular values, which are the positive square roots of the eigenvalues of the matrix X The singular values provide a direct indication of the rank of the matrix X. The number of significant components used is determined by the cumulative variance calculated from the singular values. The matrix V contains the eigenvectors of X with the eigenvectors used as the chemical patterns for samples in the data matrix X. The matrix multiplication of $U_iS_i$ gives the scores, $L_i$.

$$L_i=U_iS_i \tag{A-5}$$

The terms "fitted" and "predicted" will now be used to identify various kinds of base stocks. These terms are not interchangeable. The term "fitted" denotes that a base stock sample was used to build the compositional model. "Predicted" indicates that a base stock sample is a true prediction and was not used in building the compositional model. All of the equations that follow are based on matrix calculations to facilitate the translation to Matlab. Matlab is commercial computation software available from Math Works, Inc. (Natick, Mass.) and provides a implementation of the singular value decomposition, SVD for matrices.

The SIMCA model requires that the residual error of each class be calculated. The principal components analysis provides some error filtering of the original data. Therefore, the residual of each base stock property is also examined. Residual error gives an indication of the "tightness" of each compositional box. The SIMCA model uses the measured base stock properties and their chemical patterns, or eigenvectors, to calculate the residual error of each sample. The residual error can be estimated using linear regression techniques. The fitted residual error is defined as the difference between the observed values $X_i$ and the fitted, i.e., projected, values of $X_i$:

$$\hat{e}=X_i-\hat{X}_i \tag{A-6}$$

The fitted values of $X_i$ can be calculated from $$\hat{X}_i=HX_i \tag{A-7}$$

The matrix H is commonly referred to as the hat matrix and transforms observed responses to fitted responses. The H matrix is estimated from $$H=X(X^TX)^{-1}X^T \tag{A-8}$$

as described by Weisberg, Sanford, *Applied Linear Regression,* 2nd Edition, p.47, John Wiley & Sons, Inc., New York, 1985, which is hereby incorporated by reference in its entirety. The fitted residual error can be re-expressed as $$\hat{e}=(1-H)X_i \tag{A-9}$$

The orthogonal matrix U, truncated down to its most significant principle components, provides the basis for an important projection associated with the SVD:

$$U_iU_i^T=\text{projection on to range }(X) \tag{A-10}$$

The projection onto the range of X provides a method for transforming observed responses to fitted responses. The projection onto the range of X from the SVD of data matrix $X_i$ provides a principal component based method for estimating the hat matrix:

$$H=U_iU_i^T \tag{A-11}$$

The residual error of the fitted data is then estimated from the equation:

$$\hat{e}=(1-U_iU_i^T)X_i \tag{A-12}$$

The residual variance of each class is calculated from the equation:

$$s_i^2=\sum_{j=1}^{NS}\sum_{k=1}^{NV}\frac{\hat{e}_{jk}^2}{(NS-NC-1)(NV-NC)} \tag{A-13}$$

where NS is the number of samples, NV is the number of variables (base stock properties), and NC is the number of principal components.

The residual error of an unknown sample, $X_u$ projected into class "i" is estimated from the significant eigenvectors and singular values:

$$U_u=X_uV_iS_i^{-1} \tag{A-14}$$

and $$\hat{e}=X_u-U_uU_i^TX_i \tag{A-15}$$

$$\hat{e}=X_u-X_uV_iS_i^{-1}U_i^TX_i \tag{A-17}$$

$$B_i=V_iS_i^{-1}U_i^TX_i \tag{A-17}$$

$$\hat{e}=X_u(1-B_i) \tag{A-18}$$

The residual variance of the unknown sample is estimated by $$S_U^2=\sum_{k=1}^{NV}\frac{\hat{e}_{UK}^2}{(NV-NC)} \tag{A-19}$$

An F-test is used to determine if the sample is outside the compositional box (volume):

$$F=\frac{S_u^2}{S_i^2} \tag{A-20}$$

As was discussed above, a second important statistic used in the SIMCA models is the Mahalanobis distance as described by Gordon, A. D., *Classification,* Chapman and Hall, 1981, herein incorporated by reference. The Mahalanobis distance (M-distance) indicates whether a projection into the compositional model space is an extrapolation. The M-distance is estimated by $$\Delta_{ii}=\sqrt{\text{diagonal}(X_{i\Gamma_i^{-1}X_i^T})} \tag{A-21}$$

The covariance matrix Γ is an unbiased estimate of the covariance matrix and can be calculated from:

$$\Gamma_i=\frac{X_i^TX_i}{NS-1} \tag{A-22}$$

The covariance matrix can be re-expressed in terms of the SVD of Xi:

$$\Gamma_i = \frac{V_i S_i^2 V_i^T}{NS-1} \quad \text{(A-23)}$$

The Mahalanobis distance for fitted samples becomes $$\Gamma_i^{-1} = (NS-1)(V_i S_i^2 V_i^T)^{-1} \quad \text{(A-24)}$$

where:

$$(V_i S_i^2 F_i^T)^{-1} = (V_i^t)^{-1}(S_i^2)^{-1}(V_i)^{-1} \quad \text{(A-25)}$$

$$V_i^T = V_i^{-1} \quad \text{(A-26)}$$

$$\Gamma_i^{-1} = (NS-1)(V_i S_i^{-2} V_i^T) \quad \text{(A-27)}$$

$$\Delta_{ii} = \sqrt{(NS-1) \times \text{diagonal}(X_{iV_{iS_i^{-2}V_{\cdots}}}} \quad \text{(A-28)}$$

or simply $$\Delta_{ii} = \sqrt{(NS-1) \times \text{diagonal}(U_{iU_{iT}})} \quad \text{(A-29)}$$

and similarly the Mahalanobis (M) distance for predicted samples becomes $$\Delta_{ii} = \sqrt{(NS-1) \times diagonal(H)} \quad \text{(A-30)}$$

Thus, a plot of the M distance versus the calculated F value provides a graphical representation of the base stock composition. The maximum M distance is a direct measure of the size of the principal component space. Base stock samples should not exceed the M distance calculated from the data used to construct the compositional model. The F statistic indicates the type of residuals that remain after the sample is projected into the principal component space. Low values of F, for a model developed with a statistically significant number of base oil samples, F<4,>95% confidence limits indicate the base stock property residuals are null. The predictive errors are due to normal errors associated with collecting analytical data. If the F value is greater than 4, the principal components do not accurately model the data, and the sample does not fit into the compositional model.

As described above, to arrive at the comprehensive compositional model, separate compositional models for both light and heavy neutrals are constructed. The compositional models for light and heavy neutrals are developed by repeating the above process for each of the respective neutral base stock's performance tests such as those listed above.

Figure 3:
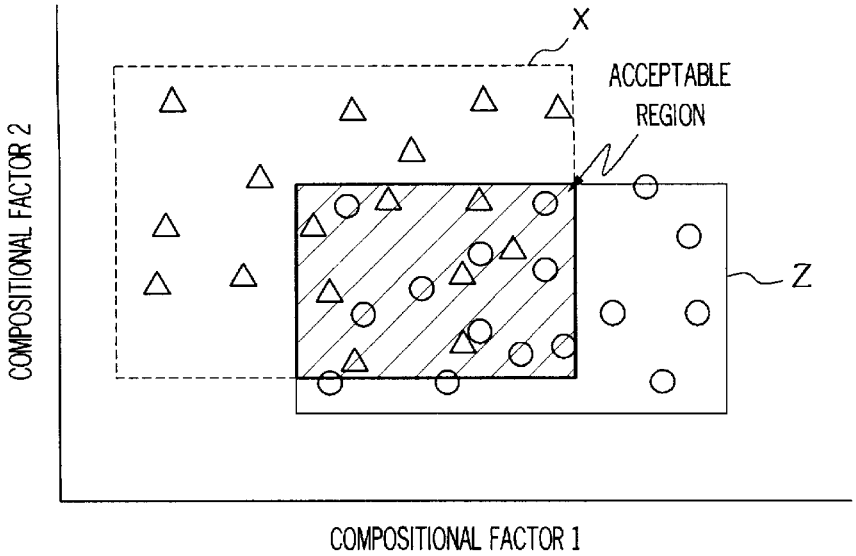
FIG. 3 is a graph showing how a compositional specification model is made for a plurality of lubricant performance tests according to one embodiment of the present invention.

FIG. 3 is a simplified illustration of how the acceptable region for each viscosity grade is generally developed. In FIG. 3, the performance of a series of lubricant base stocks of the same viscosity grade were measured in two performance tests. The performance tests could be performed on either the same lubricant product formulation or on product formulations for different applications, i.e., automotive oil lubricants, industrial oil lubricants, marine oil lubricants, etc.

Still referring to FIG. 3, the "pass" regions, x and z, for each test are plotted on one graph. For simplicity, x and y represent the "pass" regions for only two performance tests of products made by either light or heavy neutral base stock. The overlapping "pass" regions become the acceptable region defining the respective compositional model for light or heavy neutral base stocks and is, thus, predictive of lubricant performance across a wide range of lubricant products.

Adjustments for viscosity variations (step 230) may be made at this point by, for example, simple linear interpolation derived from similar compositional models having different determined parameters for different viscosities. Minor variations in viscosity outside the range determined by the compositional model may also be extrapolated. It has been found satisfactory to generate compositional models for each lubricant type such as, for example, light and heavy neutrals, using a limited range of viscosity values rather than to use a single value of viscosity for each type with adjustments for minor variations in the viscosities of the samples within each viscosity grade made by scaling composition according to typical trends of compositional variation with viscosity as described above. Thus, once the compositional model for the respective light and heavy neutral base stocks are developed, the comprehensive compositional model allows the accurate interpolation of the acceptable performance regions of base stocks of intermediate viscosity from the light and heavy neutral models. The interpolation is performed by another manipulation.

In order to interpolate the compositional model, the following compositional modeling principle is employed: a base stock of intermediate viscosity is approved if it is possible to mimic its composition as a blend of two acceptable light and heavy neutrals.

In one embodiment of the present invention, the compositional model employs ellipses or ellipsoids to define the acceptable region, however, other geometrical figures can also be used. A simple linear interpolation of the principal component ends of the "ellipsoid" designated as the acceptable performance region, for example, could be used such that at every viscosity a different ellipse is used. Linear interpolations of orthogonal axes, however, are not orthogonal, and the desirable properties of the principal components would be lost.

Thus, the interpolations are accomplished by "morphing" one ellipsoid into another, i.e., linearly translating the center of the ellipse as a function of viscosity, while gradually rotating the ellipsoid, and expanding/contracting the ellipsoid axes according to their singular-value scales. This can be achieved if the compositional models are in the same "space", and they have the same number of principal components.

In matrix notation, there is a square non-symmetric rotation transformation matrix T, that applied to a matrix $V_o$ of mean-centered ortho-normal principal components, will rotate it exactly into the orthonormal principal components of another model, $V_1$:

$$TV_0 = V_1 \quad \text{(B1)}$$

Since $V_o$ is ortho-normal, T is simply expressed as $$Tv_o V_o = T = V_1 V_o. \quad \text{(B2)}$$

Intermediate axes between model 0 and model 1 can be expressed as fractional rotations of T. Fortunately, well-developed matrix algebra exists for fractional transformations. If we define z=0 for model 0 (light neutral), and z=1 for model 1 (heavy neutral), any intermediate set of rotated axes $V_z$ can be expressed as:

$$V_z = T^z V_o = ED^z EV_o \quad \text{(B3)}$$

where $T^z$ is the z-matrix power of T, computed from Ts eigen-analysis TE−ED, where E is ortho-normal and D is diagonal, and $D^z$ is also diagonal, with the diagonal elements of D raised to the z power. Since T is not symmetric, both E and D will contain conjugate pairs of complex eigenvectors-eigenvalues, requiring complex algebra.

Additional complications need to be addressed before computing $V_z$ for a given $V_1$ and $V_0$. One is chirality, and the other is alignment. Chiral objects are mirror images of each other. Therefore, it is impossible to rotate a chiral object into its mirror image. Likewise, a set of orthogonal vectors in multidimensional space has a certain characteristic or "sense" that is analogous to chirality. The only valid rotations that do not drastically deform the vectors into imaginary planes in intermediate steps are those that transform between sets of vectors with the same chirality, or sense. Thus, to overcome this problem, the $V_1$ columns are multiplied by −1 until the intermediary transformation vectors $V_{0.5}$ are in the real plane.

The last complication of alignment is solved by computing all possible rotations in the real plane, and comparing their rotation "distance" for the $1^{st}$, $2^{nd}$, . . . , $N^{th}$ principal components, until the rotation with the minimal angular change as a function of z change is found.

Once the proper rotation is found, the rest of the compositional model parameters are interpolated accordingly. The average, axis scaling, and Mahalanobis distance are interpolated linearly, while the f-ratio and the residual variance are interpolated quadratically.

This technique can be extended to a viscosity grade higher or lower than heavy or light neutrals, respectively. For example, by developing a compositional model for bright stocks (i.e. −VI of approximately 30 centastokes), one skilled in the art can readily interpolate for viscosity ranges between heavy neutrals and bright stocks.

Prediction of product performance for products of all viscosities are made and compared to the actual performance at those viscosities. If the accuracy of the predictions at viscosities between those for which the compositional models were developed is less than that at the viscosities for which the compositional models were developed, additional compositional models can be developed at more viscosities until the accuracy is satisfactory. Once the comprehensive compositional model is determined across a plurality of products, for example, PVL, CVL, marine, and industrial lubricants, the comprehensive compositional model necessarily incorporates the performance levels of each finished product formulation. Thus, any lubricant base stock, selected according to any variety of ways, having any viscosity, whose lubricant performance is unknown in a finished lubricant product formulation, merely has to be analyzed for the chemical concentrations of the key compositional parameters (step 240). Once evaluated against the compositional model, the lubricant base stock either falls into the acceptable region or it does not. Thus, the compositional model predicts whether the lubricant base stock is acceptable for use in all lubricant products or not acceptable for use as a lubricant, at least in its present form.

Figure 4:
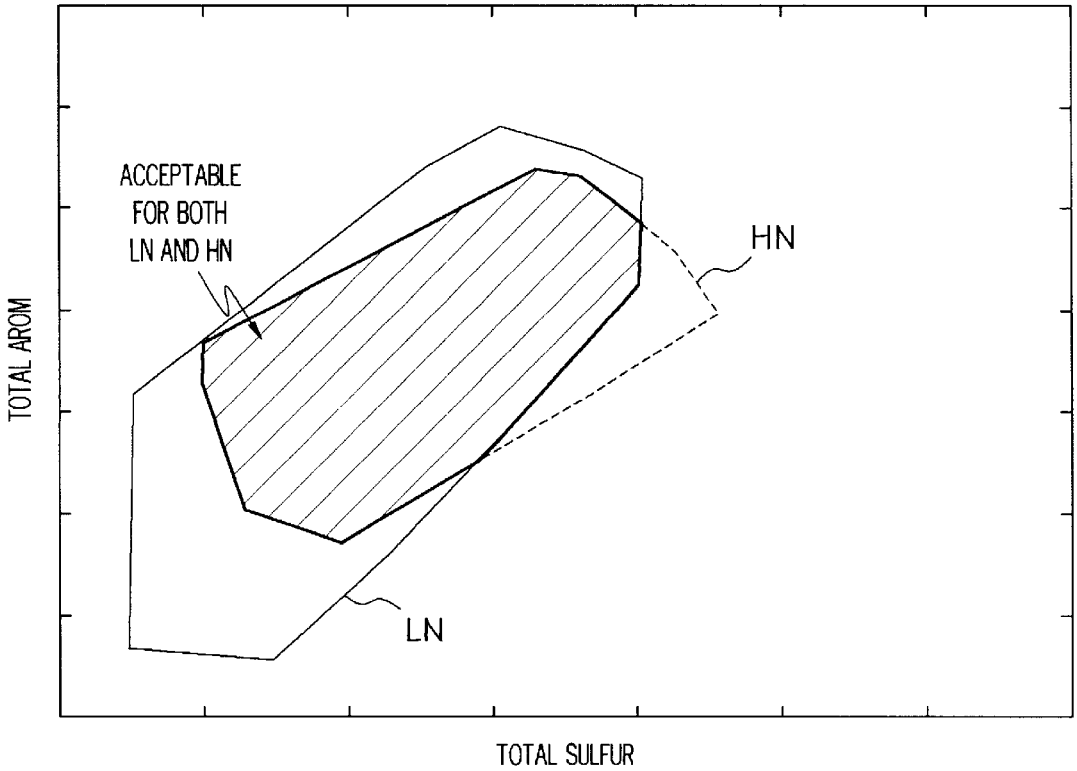
FIG. 4 is a graph showing the overlap of the compositional specification models developed for light and heavy neutral base stocks according to one embodiment of the present invention.

FIG. 4 shows the compositional model comprised of the acceptable compositional regions for the light and heavy neutral models. While there is considerable overlap between the acceptable regions for the light and heavy neutral compositional models, this is not the most efficient way to use the compositional model. Rather, the most efficient way to use the compositional model is in its comprehensive form as such comprehensive compositional model employs all reasonable interpolations for viscosity in between these extremes. Since both light and heavy neutrals are produced from a given crude, the compositional model, as shown in FIG. 4, indicates that many potential crudes are suitable to be used for lubricant products over a plurality of viscosities, as long as there is overlap in the acceptable areas as determined by the compositional model for the plurality of viscosities. The lower sulfur and aromatics region, however, is acceptable for light neutrals but not acceptable for heavy neutrals. As shown, such a region generally provides good Sequence VE, Mack T-8, and CEO Caterpillar 1M-PC performance.

As described above, the compositional model is based on lubricant base stock compositions known to yield good lubricants. In other embodiments of the invention, options are available for those base stock compositions that have been designated by the compositional model as "failed." For example, in one embodiment of the invention, the "failed" sample may be blended with a base stock that has ?"passed" to yield an acceptable composition. This embodiment is illustrated in FIG. 5.

Figure 5:
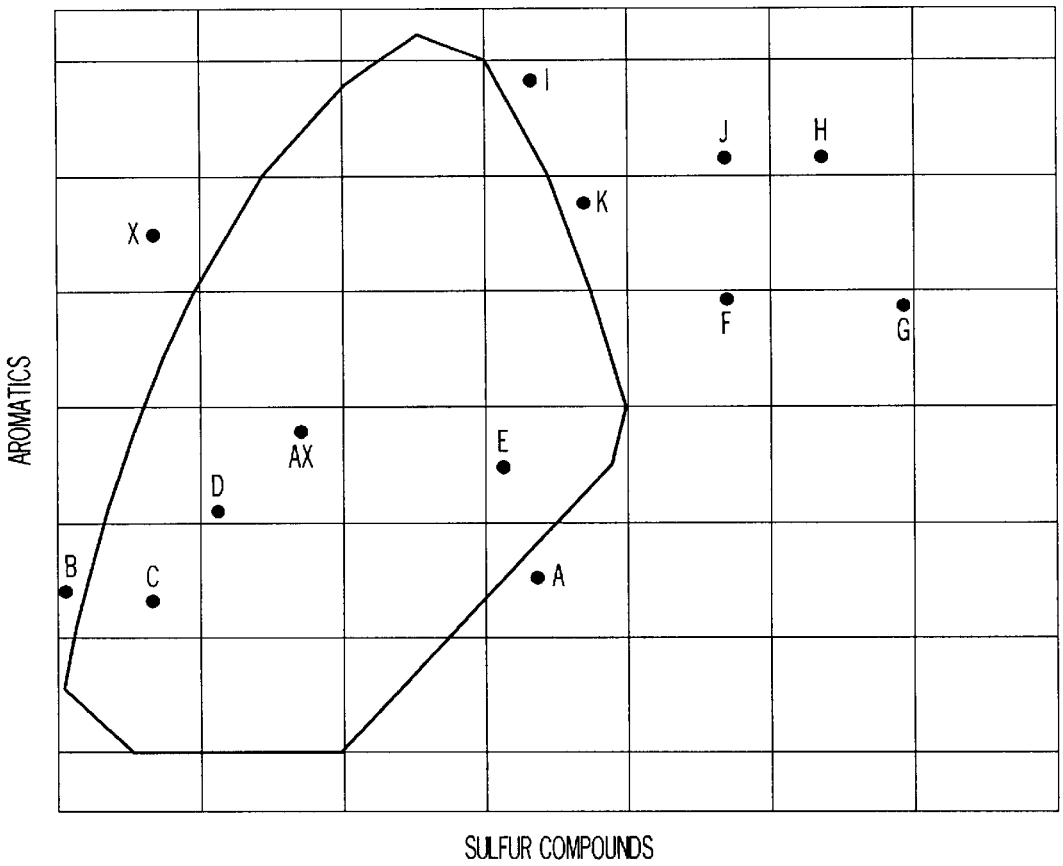
FIG. 5 is a graph showing a compositional specification model for light neutral base stocks, where such graph is used in connection with a method to blend a plurality of base stocks to yield a resulting blended base stock whose composition is within the acceptable region predicted by the compositional model.

FIG. 5 shows an approximate two-dimensional representation of the acceptable region of the compositional model for a light neutral with the concentration of total aromatics versus total sulfur as the compositional parameters. The light neutral base stocks of a plurality of crudes are plotted on the graph according to the relative concentrations of total aromatics and total sulfur. Some of the crudes produce light neutrals whose compositional components fall within the acceptable region of the compositional model, and some do not. Those that do not fall within the acceptable region, however, may be blended with a base stock composition that does fall within the acceptable region. Base stock compositions can be blended only if the compositions between the two or more base stocks to be blended (step 260) are complementary. For example, in FIG. 5, the light neutral base stock produced from crude J contains a high amount of aromatics and a high concentration of total sulfur. Such base stock produced from crude J, could be blended with the light neutral base stock produced from crude D, for example, which contains a lower level of both total aromatics and sulfur such that the combined product is well within the acceptable region predicted by the compositional model. Knowing the concentrations of the compositional parameters allows a calculation of the amounts of each base stock required to achieve a resultant base stock composition whose compositional parameters are within the acceptable region (steps 270 and 280).

Two "failing" base stocks can also be combined in this manner as long as their compositions are complementary in such a way that their combination will result in a base stock whose compositional parameters fall within the compositional model's predicted acceptable region. Referring again to FIG. 5, the light neutral base stock produced from crude A, for example, can be combined with the light neutral base stock from crude X to form the "passing" light neutral base stock AX. In contrast, the light neutral base stock produced from crude A cannot be combined with the light neutral base stock from crude Y to yield a "passing" combination as the bias in composition of each base stock is not favorable enough to achieve a "passing" resultant base stock.

Figure 1:
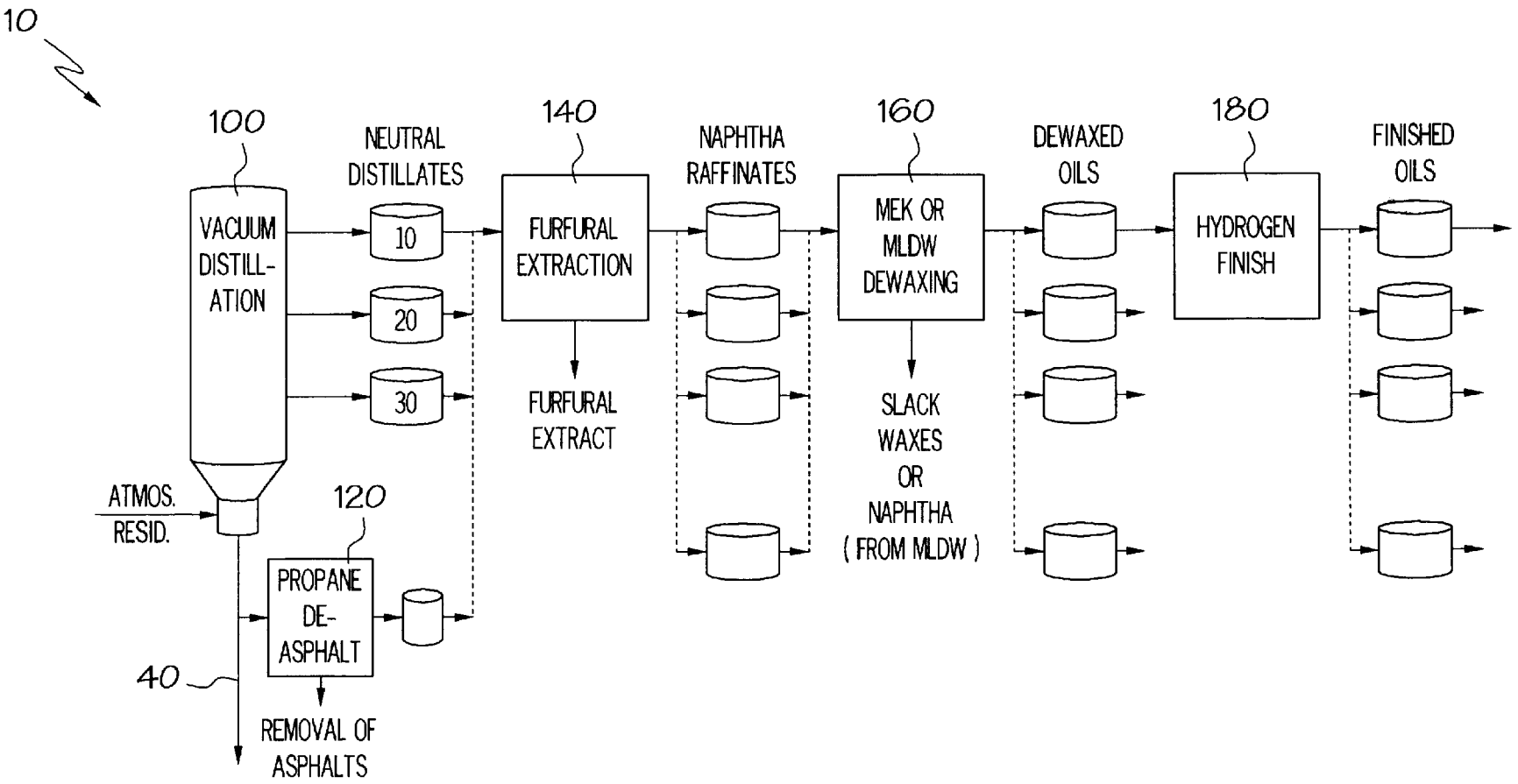
FIG. 1 is a flow diagram showing an overview of a current lube base stock manufacturing process.

In another embodiment of the present invention, the compositional model allows the integration of known refining data with the prediction of lubricant performance. For example, the compositions of the base stocks produced from the world's crudes can be readily determined by conventional analytical techniques by those skilled in the art. Thus, knowing either a selected crude or selected base stock's refining data allows one to determine whether the selected crude or base stock can be refined to within the acceptable region predicted by the compositional model (step 285). In the case of a crude, knowing the selected crude's refining data allows one to determine whether the selected crude can be refined to produce a base stock whose composition is within the acceptable region predicted by the compositional model. For example, it is known in the art of lube manufacturing that as the furfural extraction severity is increased (step 140 in FIG. 1), certain key compositional components, such as, for example, total aromatics and aliphatic sulfur, decrease when a base stock is solvented. For this extraction step, any commercial refinery extraction process can be employed.

Preferably, however, the extraction process is a continuous flow process. In most continuous flow commercial processes, the oil is introduced into the lower part of the vessel with a multiplicity of mixers inside. The multiplicity of mixers allows the refinery to control the severity of the extraction. A solvent is introduced near the top of the vessel. The solvent is typically liquid sulfur dioxide mixed with benzene, furfural, propane, phenol, N-methylpyrrolidone, or the like. A furfural extraction is preferred. The solvent then works its way towards the bottom of the vessel dissolving the extract as it goes along. The remaining solvent-refined stock, or raffinate, rises to the top of the vessel and is separated from the solvent-containing extract.

In addition, it is known in the art that hydroprocessing (step 180 in FIG. 1) also removes sulfur from the base stock. Any commercial refinery hydroprocessing method can be employed. Most commercial hydroprocessing operations entail mixing the stream of base stock with hydrogen at temperatures from about 500 to about 800 degrees F. The oil combined with the hydrogen is then charged to a vessel filled with a catalyst so that the required reactions can occur. The oil is then sent to a flash tank to remove hydrogen sulfide and any light hydrocarbons that may have resulted during the catalytic reaction.

Figure 6:
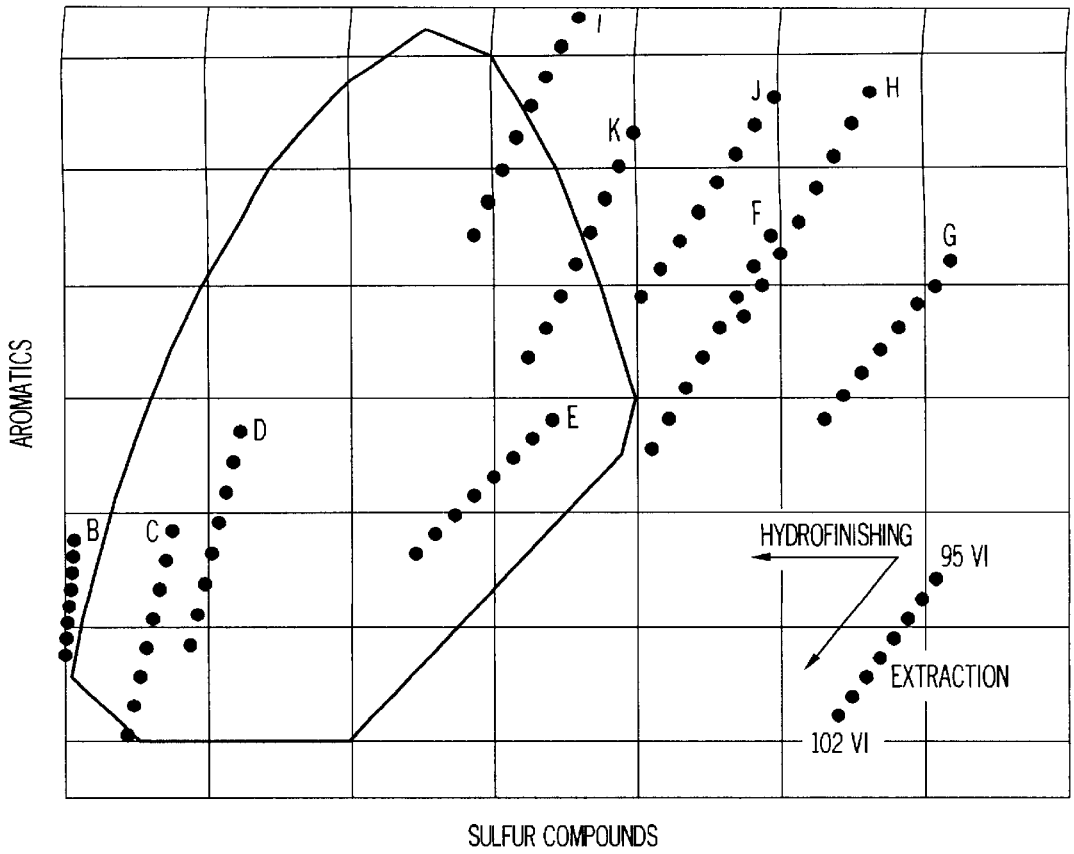
FIG. 6 is a graph similar to the graph of FIG. 5, and shows the compositional specification model of FIG. 5 used with extraction severity data to obtain a base stock whose composition is within the acceptable region predicted by the compositional model.

Referring now to FIG. 6, the effect of the commercial extraction processes on, for example, light neutral base stocks is shown relative to the light neutral compositional model with the concentration of total aromatics versus total sulfur as the compositional parameters. To determine whether a base stock can be refined to yield a composition within the acceptable region, a series of base stocks produced from different crudes is plotted to illustrate the effects of extraction severity on the base stocks. The effects of the extraction processes on the viscosity index (VI) is also shown. Here, it is evident that if a base stock produced from a certain crude has a high concentration of, for example, total aromatics and total sulfur such that it is outside of the acceptable region predicted by the compositional model, such as, for example, the base stock produced by crude K, the base stock may be further refined (step 290) to a point where its composition does fall within the acceptable region predicted by the compositional model. Likewise, the extracted base stocks can be combined in the manner described above to yield a composition within the acceptable region predicted by the compositional model.

In other embodiments of the present invention, knowing the refining data of a plurality of crudes allows one skilled in the art practicing this invention to predict, based on the composition of the base stocks produced from such crudes, to predict and blend a crude composition from among the known crudes that, when refined, will yield a base stock having a composition within the acceptable region determined by the model. Likewise, knowing the composition and viscosity of any stream in the refinery, such as, for example, those shown in FIG. 1, a composition can be predicted and blended that will further refine into a base stock having a composition within the acceptable region determined by the model.

The compositional changes that depend on changes in refining, either solvent or hydroprocessing, are well known and can easily be modeled for the purposes of selecting suitable refinery streams from known crude sources and for selecting suitable crudes themselves. In particular, the effects of unit processes such as, for example, distillation, solvent extraction, dewaxing, and hydroprocessing can be modeled and used according to the present understanding. This modeling includes such elements as aromatics level and type, sulfur level and types, nitrogen level and types, and may include others as required. The effects of unit processes should include such parameters as distillation cut points, solvent dosage and temperatures, contact times, dewaxing dosages and temperature profiles, hydrogen pressure, temperature, catalyst type, conversion and hydrogen treat rate.

Figure 7:
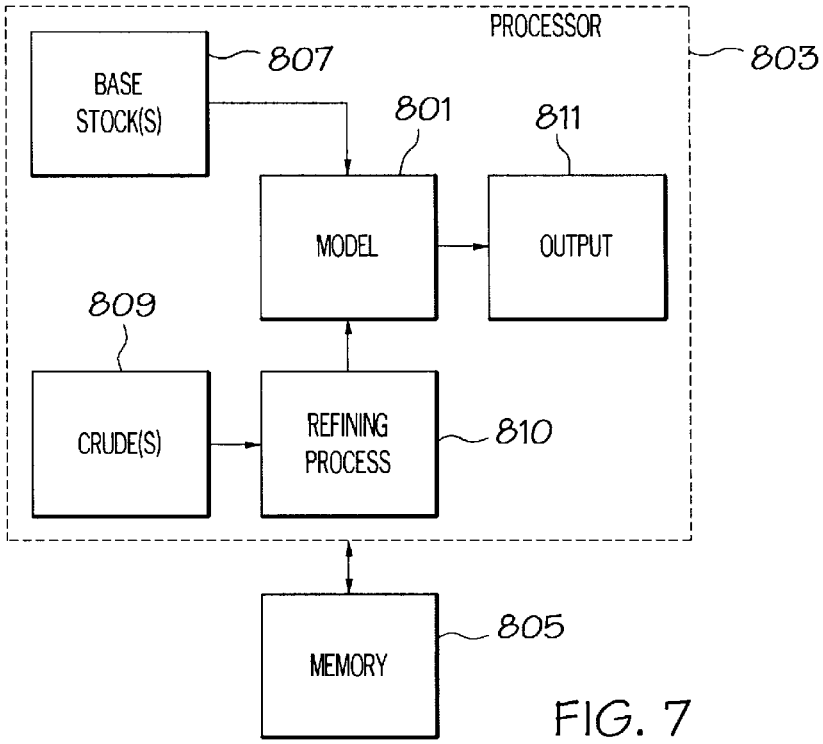
FIG. 7 is a block diagram illustrating the operation of an embodiment of the present invention.

Referring now to FIG. 7, it is seen that in one embodiment of the present invention, the compositional model 801 developed as discussed above is run on a computer or processor 803 having attached memory 805. The processor 803 and memory 805 may be any appropriate processor and memory, respectively, without departing from the spirit and scope of the present invention. For example, the processor may be PC-based or main-frame-based and the memory may be RAM, ROM, or any appropriate storage device such as a hard drive and the like.

Still referring to FIG. 7, the compositional model typically receives as input data representing a base stock 807 or base stocks 807 (in the blending case), or data representing a crude 809 or crudes 809 (in a blending case). Regarding the data representing the crude(s) 809, the model may also receive as input data representing the refining data 810 of the particular crude(s) 809. Typically, the compositional parameters are, in fact, input in the base stock(s) case, or are predicted in the case of crude(s). Typically, appropriate information on the compositional parameters is available as assay data which is stored in the memory 805 in the case of the base stock(s). In the case of crudes, such compositional parameters may be predicted from a library of industry data which is also stored in the memory 805. Once presented with such data, the compositional model predicts whether the inputted base stock(s) 807 or crude(s) 809 are acceptable in accordance with the method as described above and provides an appropriate output 811.

While the present invention has been described in connection with the various Figures, it is to be understood that other embodiments may be used or modifications and additions may be made to the described embodiment for performing the same function of the present invention without deviating therefrom. Therefore, the present invention should not be limited to any single embodiment, but rather should be construed in breadth and scope in accordance with the recitation of the appended claims.

What is claimed is:

1. A method for selecting a lubricant base stock for use in manufacturing a lubricant for a particular application, the base stock being characterizable according to a plurality of compositional components common to a plurality of lubricant base stocks, each compositional component varying in amount with respect to the base stocks, the method comprising the steps of:

identifying particular ones of the plurality of compositional components in a lubricant base stock that, in combination, are probative of lubricant performance for a plurality of applications;

determining an acceptable range for a combination of the identified compositional components at at least two viscosities from a plurality of performance tests on a plurality of lubricant products, each lubricant product having a viscosity, the plurality of lubricant products having a plurality of different viscosities, thereby defining a compositional model at each of the at least two viscosities;

adjusting for viscosity variations for lubricant base stocks whose viscosities differ from that of the at least two viscosities by adjustment of the compositional model's parameters from at least two compositional models at values of viscosity differing from those of a candidate lubricant base stock to derive an acceptable range of compositional components, in combination, at the viscosity of the candidate lubricant base stock;

determining the amounts of the identified compositional components in a candidate lubricant base stock; and determining whether the amount of each identified component in the candidate base stock, in combination, is within the acceptable range for such identified components.

2. The method of claim 1 wherein the determined acceptable range for each identified component is selected from the group consisting of an acceptable range that is independent of any other identified component and an acceptable range that is inter-related to an acceptable range of another identified component.

3. The method of claim 1 wherein the identifying step comprises selecting compositional components from the group consisting of basic nitrogen, sulfur, aliphatic sulfur, aromatics, and a combination thereof.

4. A method according to claim 1 in which the adjustment for viscosity variations is made by interpolation of compositional model parameters between compositional model parameters for a compositional model at a viscosity nearest above the viscosity of the candidate lubricant base stock and the compositional model parameters at the viscosity nearest below the viscosity of the candidate lubricant base stock.

5. A method according to claim 4 in which the compositional models for at least one of the compositional models at the viscosity value nearest above that of the candidate lubricant base stock and the viscosity value nearest below that of the candidate lubricant base stock are generated with variations about a viscosity grade with adjustments for viscosity variations within the viscosity grade made by scaling compositional variations with viscosity.

6. A method according to claim 1 wherein the adjustment for viscosity variations is made by interpolation of compositional model parameters between the compositional model parameters for the compositional model at the viscosity next higher than the viscosity of the candidate lubricant base stock and the compositional model parameters at the viscosity next below the viscosity of the candidate lubricant base stock.

7. A method according to claim 1 wherein the adjustment for viscosity variations is made by extrapolation of compositional model parameters from compositional model parameters at viscosities differing from the viscosity of the candidate lubricant base stock.

8. A method for selecting lubricant base stocks, from among a plurality of lubricant base stocks, for use in manufacturing a lubricant for a particular application, each base stock being characterizable according to a plurality of compositional components common to all of the base stocks, each compositional component varying in amount with respect to each base stock, the method comprising the steps of:

identifying particular ones of the plurality of compositional components in a base stock that, in combination, are probative of lubricant performance for the particular application;

determining an acceptable range for a combination of the identified compositional components at at least two viscosities from a plurality of performance tests on a plurality of lubricant products, each lubricant product having a viscosity, the plurality of lubricant products having a plurality of different viscosities, thereby defining a compositional model at each of the at least two viscosities;

adjusting for viscosity variations for lubricant base stocks whose viscosities differ from that of the at least two viscosities by adjustment of the compositional model's parameters from at least two compositional models at values of viscosity differing from those of a candidate lubricant base stock to derive an acceptable range of compositional components, in combination, at the viscosity of the candidate lubricant base stock;

determining the amounts of the identified compositional components in each of a plurality of selected base stocks;

determining whether the plurality of selected base stocks can be combined such that the amount of each identified component in the combination is within the acceptable range for such identified component;

determining a required amount of each of the plurality of selected base stocks to combine to define the combination to be used in a final lubricant composition that will perform within the acceptable range for each identified component; and blending the required amount of each selected base stock required in the final lubricant composition.

9. The method of claim 8 wherein the determined acceptable range for each identified component is selected from the group consisting of an acceptable range that is independent of any other identified component and an acceptable range that is inter-related to an acceptable range of another identified component.

10. The method of claim 8 wherein the identifying step comprises selecting compositional components from the group consisting of basic nitrogen, sulfur, aliphatic sulfur, aromatics, and a combination thereof.

11. The method of claim 8 wherein at least one of the selected base stocks having amounts of the identified compositional components within the determined acceptable range.

12. The method of claim 8 wherein no one of the selected base stocks has amounts of the identified compositional components within the determined acceptable range.

13. A method according to claim 8 wherein the adjustment for viscosity variations is made by interpolation of compositional model parameters between the compositional model parameters for the compositional model at the viscosity next higher than the viscosity of the candidate lubricant base stock and the compositional model parameters at the viscosity next below the viscosity of the candidate lubricant base stock.

14. A method according to claim 8 wherein the adjustment for viscosity variations is made by extrapolation of compositional model parameters from compositional model parameters at viscosities differing from the viscosity of the candidate lubricant base stock.

15. A computer-readable medium for use in connection with a method for selecting a base stock from among a plurality of base stocks for use in manufacturing a lubricant for a particular application, each base stock being characterizeable according to a plurality of compositional components common to all of the base stocks, each compositional component varying in amount with respect to each base stock, the medium having computer-implementable instructions thereon for performing the steps of:

identifying particular ones of the plurality of compositional components in a base stock that are probative of lubricant performance for a plurality of applications;

determining an acceptable range for a combination of the identified compositional components at at least two viscosities from a plurality of performance tests on a plurality of lubricant products, each lubricant product having a viscosity, the plurality of lubricant products having a plurality of different viscosities, thereby defining a compositional model at each of the at least two viscosities;

adjusting for viscosity variations for lubricant base stocks whose viscosities differ from that of the at least two viscosities by adjustment of the compositional model's parameters from at least two compositional models at values of viscosity differing from those of a candidate lubricant base stock to derive an acceptable range of compositional components, in combination, at the viscosity of the candidate lubricant base stock;

determining the amounts of the identified compositional components in a candidate base stock; and determining whether the amount of each identified component in the candidate base stock is within the acceptable range for such identified component.

16. The computer-readable medium of claim 15 having computer-implement-able instructions thereon for performing the further steps of:

selecting one of the base stocks as a candidate base stock;

determining the amounts of the identified composition components in a candidate base stock; and determining whether the amount of each identified component in candidate stock is within the acceptable range for such identified component.

17. A method for blending a combination of petroleum refinery streams from among a plurality of such refinery streams, the selected blend to be used in manufacturing a lubricant base stock for a particular lubricant application, each of the streams being capable of being refined into lubricant base stocks characterizable according to a plurality of compositional components common to a plurality of the base stocks, each compositional component varying in amount with respect to each base stock, the method comprising the steps of:

identifying particular ones of the plurality of compositional components in a base stock that, in combination, are probative of lubricant performance for the particular application;

determining an acceptable range for a combination of the identified compositional components at at least two viscosities from a plurality of performance tests on a plurality of lubricant products, each lubricant product having a viscosity, the plurality of lubricant products having a plurality of different viscosities, thereby defining a compositional model at each of the at least two viscosities;

adjusting for viscosity variations for lubricant base stocks whose viscosities differ from that of the at least two viscosities by adjustment of the compositional model's parameters from at least two compositional models at values of viscosity differing from those of a candidate lubricant base stock to derive an acceptable range of compositional components, in combination, at the viscosity of the candidate lubricant base stock;

identifying the amounts of the identified compositional components for a lubricant base stock which is to be refined from the plurality of refinery stream;

determining the composition of the blend of the streams in accordance with the combination of identified components within the acceptable range for such identified components for the particular application, and blending the streams in accordance with the determined composition.

18. A method according to claim 17 in which the determination of the blend of composition of the blend of streams is made in accordance with the composition of the streams and a refining processing model which correlates stream composition with the composition of the lubricant base stock according to the identified components.

19. A method according to claim 18 in which the determination of the blend of composition of the blend of streams is made in accordance with the composition of the streams and a refining processing model which correlates stream composition with the composition of the lubricant base stock according to the identified components and with acceptable refining conditions.

20. A method according to claim 17 in which the refinery streams are crude oils.

21. A method according to claim 20 in which the crude oil is subjected to a refining process model comprised of unit subtractive refining operations including distillation, solvent extraction and dewaxing, wherein the refining process model accounts for compositional changes that depend on changes in the unit subtractive refining operations.

22. A method according to claim 21 wherein the refining process model includes unit process models for distillation, solvent extraction and dewaxing.

23. A method according to claim 17 in which the refinery streams are gas oils.

24. A method according to claim 23 in which the gas oils are subjected to a refining process model comprised of unit subtractive refining operations including distillation, solvent extraction and dewaxing, wherein the refining process model accounts for compositional changes that depend on changes in the unit subtractive refining operations.

25. A method according to claim 24 in which the refining process model includes unit process models for solvent extraction and dewaxing of the gas oils.

26. A method according to claim 17 in which the refinery streams are raffinates produced by solvent extraction of a vacuum distillate.

27. A method according to claim 26 in which the raffinates are subjected to a refining process model comprised of unit subtractive refining operations including distillation, solvent extraction and dewaxing, wherein the refining process model accounts for compositional changes that depend on changes in the unit subtractive refining operations.

28. A method according to claim 27 in which the refining process model includes unit process models for dewaxing of the raffinate.

29. The method of claim 17 wherein the determined acceptable range for each identified component is selected from the group consisting of an acceptable range that is independent of any other identified component and an acceptable range that is inter-related to an acceptable range of another identified component.

30. The method of claim 17 wherein the identifying step comprises selecting compositional components from the group consisting of basic nitrogen, sulfur, aliphatic sulfur, aromatics, and a combination thereof.

31. The method of claim 17 further comprising the step of blending the required amount of each crude required in the crude composition.

32. The method of claim 17 further comprising the step of blending the required amount of each refinery stream required in the composition of refinery streams.

33. The method of claim 17 wherein the plurality of refinery streams comprises distillates, raffinates, crudes, atmospheric residuals, bright stocks, dewaxed oils, base stocks, and any combination thereof.

34. A method according to claim 17 in which the refinery streams are raffinates produced by solvent extraction of a vacuum distillate.

35. A method according to claim 17 wherein the adjustment for viscosity variations is made by interpolation of compositional model parameters between the compositional model parameters for the compositional model at the viscosity next higher than the viscosity of the candidate lubricant base stock and the compositional model parameters at the viscosity next below the viscosity of the candidate lubricant base stock.

36. A method according to claim 17 wherein the adjustment for viscosity variations is made by extrapolation of compositional model parameters from compositional model parameters at viscosities differing from the viscosity of the candidate lubricant base stock.

37. A method for manufacturing a lubricant base stock by blending and refining a plurality of petroleum refinery streams, the base stock to be used in manufacturing a lubricant for a particular application, where none of the refining streams is capable of being refined under acceptable refining conditions into the lubricant base stock, the method comprising:

characterizing the lubricant base stock according to a plurality of compositional components common to a plurality of lubricant base stocks, each compositional component varying in amount with respect to each base stock, identifying particular ones of the plurality of compositional components in a base stock that, in combination, are probative of lubricant performance for the particular application;

determining an acceptable range for a combination of the identified compositional components at at least two viscosities from a plurality of performance tests on a plurality of lubricant products, each lubricant product having a viscosity, the plurality of lubricant products having a plurality of different viscosities, thereby defining a compositional model at each of the at least two viscosities;

adjusting for viscosity variations for lubricant base stocks whose viscosities differ from that of the at least two viscosities by adjustment of the compositional model's parameters from at least two compositional models at values of viscosity differing from those of a candidate lubricant base stock to derive an acceptable range of compositional components, in combination, at the viscosity of the candidate lubricant base stock;

identifying the amounts of the identified compositional components for each of the plurality of refinery streams;

determining a composition for the blended refinery streams such that the blended combination will refine into the lubricant base stock whose amount of each identified component, in combination, is within the acceptable range for such identified components for the particular application, and blending the streams in accordance with the composition determined for the blended streams.

38. A method according to claim 37 in which the determination of the composition of the blend of streams is made in accordance with the composition of the streams and a refining processing model which correlates stream composition with the composition of the selected lubricant base stock according to the identified components.

39. A method according to claim 38 in which the determination of the composition of the blend of streams is made in accordance with the composition of the streams and a refining processing model which correlates stream composition with the composition of the lubricant base stock according to the identified components and with acceptable refining conditions.

40. A method according to claim 37 in which the refinery streams are crude oils.

41. A method according to claim 37 in which the refinery streams are gas oils.

42. A method according to claim 37 wherein the adjustment for viscosity variations is made by interpolation of compositional model parameters between the compositional model parameters for the compositional model at the viscosity next higher than the viscosity of the candidate lubricant base stock and the compositional model parameters at the viscosity next below the viscosity of the candidate lubricant base stock.

43. A method according to claim 37 wherein the adjustment for viscosity variations is made by extrapolation of compositional model parameters from compositional model parameters at viscosities differing from the viscosity of the candidate lubricant base stock.

44. A method for manufacturing a lubricant base stock composition by blending a plurality of lubricant base stocks, the base stock composition to be used in manufacturing a lubricant for a particular application, where none of the plurality of base stocks is acceptable as the lubricant base stock, the method comprising:

characterizing the lubricant base stock according to a plurality of compositional components common to the plurality of lubricant base stocks, each compositional component varying in amount with respect to each base stock, identifying particular ones of the plurality of compositional components in a base stock that, in combination, are probative of lubricant performance for the particular application;

determining an acceptable range for a combination of the identified compositional components at at least two viscosities from a plurality of performance tests on a plurality of lubricant products, each lubricant product having a viscosity, the plurality of lubricant products having a plurality of different viscosities, thereby defining a compositional model at each of the at least two viscosities;

adjusting for viscosity variations for lubricant base stocks whose viscosities differ from that of the at least two viscosities by adjustment of the compositional model's parameters from at least two compositional models at values of viscosity differing from those of a candidate lubricant base stock to derive an acceptable range of compositional components, in combination, at the viscosity of the candidate lubricant base stock;

identifying the amounts of the identified compositional components for each of the plurality of base stocks;

determining a composition for a blend of selected ones of the base stocks such that the composition of the blended combination of base stocks with respect to the identified components is within the acceptable range for such identified components for the base stock for the particular application, and blending the base stocks in accordance with the composition determined for the blend.

45. A method according to claim 44 in which the blend is a binary blend of two base stocks, neither of which has a composition which is acceptable for the selected base stock for the particular application.

46. A method according to claim 44 in which the compositions of the base stocks which are not acceptable for the selected base stock for the particular application are complementary for at least one of the identified components.

47. A method according to claim 46 in which at least one of the base stocks which is not acceptable for the selected base stock has a composition in which the amount of at least one of the identified components is below the acceptable range for that component in the selected base stock and the amount of the same at least one component in the base stock having the complementary composition is above the acceptable range for that at least one component.

48. A method according to claim 44 in which the blend is a binary blend of two base stocks neither of which is acceptable for the selected base stock.

49. A method according to claim 44 wherein the adjustment for viscosity variations is made by interpolation of compositional model parameters between the compositional model parameters for the compositional model at the viscosity next higher than the viscosity of the candidate lubricant base stock and the compositional model parameters at the viscosity next below the viscosity of the candidate lubricant base stock.

50. A method according to claim 44 wherein the adjustment for viscosity variations is made by extrapolation of compositional model parameters from compositional model parameters at viscosities differing from the viscosity of the candidate lubricant base stock.

* * * * *